US008157221B2

(12) United States Patent
Landow

(10) Patent No.: US 8,157,221 B2
(45) Date of Patent: Apr. 17, 2012

(54) RAILWAY SWITCH APPARATUS USING DUAL COMB STRUCTURES

(76) Inventor: Herbert Trask Landow, Binghamton, NY (US)

( * ) Notice: Subject to any disclaimer, the term of this patent is extended or adjusted under 35 U.S.C. 154(b) by 0 days.

(21) Appl. No.: 12/806,727

(22) Filed: Aug. 19, 2010

(65) Prior Publication Data

US 2012/0043431 A1 Feb. 23, 2012

(51) Int. Cl.
*E01B 7/00* (2006.01)

(52) U.S. Cl. ..... 246/433

(58) Field of Classification Search ..... 246/415 R, 246/420, 421, 423, 424, 430, 433, 435 R; 104/130.01, 130.04, 130.08
See application file for complete search history.

(56) References Cited

U.S. PATENT DOCUMENTS

| | | | | |
|---|---|---|---|---|
| 1,107,444 | A * | 8/1914 | Pipes | 246/433 |
| 1,112,965 | A | 10/1914 | Anderson | |
| 1,193,887 | A | 8/1916 | Freeburg | |
| 1,194,441 | A | 8/1916 | Teller | |
| 1,252,662 | A | 1/1918 | Cobb | |
| 1,273,984 | A | 7/1918 | Alonzo | |
| 1,355,262 | A | 10/1920 | Quintal | |
| 1,399,914 | A | 12/1921 | Alonzo | |
| 1,574,027 | A | 2/1926 | Freeburg | |
| 1,790,548 | A | 1/1931 | Lofstrand | |
| 2,779,583 | A | 1/1957 | Bone | |
| 3,591,799 | A | 7/1971 | Lica | |
| 3,626,857 | A | 12/1971 | Omar | |
| 3,630,439 | A | 12/1971 | Cook | |
| 3,661,091 | A | 5/1972 | Noble | |
| 4,215,837 | A | 8/1980 | Uozumi | |
| 4,484,526 | A | 11/1984 | Uozumi | |
| 5,277,124 | A | 1/1994 | DiFonso | |
| 5,325,789 | A | 7/1994 | Tapias | |

FOREIGN PATENT DOCUMENTS

EP 0 712 772 B1 10/1991

* cited by examiner

*Primary Examiner* — S. Joseph Morano
*Assistant Examiner* — R. J. McCarry, Jr.
(74) *Attorney, Agent, or Firm* — Gray Robinson, P.A.

(57) ABSTRACT

A switch point (20) is alternatively raised and lowered. An upper comb structure (22) has a switch point (20) on its upper surface and teeth (23) on a lower surface. A lower comb structure (24) has compatible teeth (25) on its upper surface. The upper comb (22) moves only vertically. The lower comb structure (24) moves only horizontally. The combs may assume a raised configuration wherein the upper comb teeth (23) are supported on the lower comb teeth (25), or alternatively, a lowered configuration wherein the upper and lower comb teeth are nested. The comb structures (22, 24) have either laterally or longitudinally disposed teeth, and may be either linear or curvilinear with respect to a longitudinal axis. The combs and switch point are enveloped within containment walls (36) and end plates (38) so as to be a largely sealed unit.

2 Claims, 6 Drawing Sheets

RAILWAY SWITCH APPARATUS USING DUAL COMB STRUCTURES

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of the Invention

The invention pertains to vertically positioning railway switch points by utilizing the motion of two interacting comb structures.

2. Prior Art

For over 150 years switch points have moved by sliding in a horizontal plane. Throughout this long period innovation hopes have been focused on moving the switch points in a vertical plane. The virtues of vertically moving switch points include avoidance of blockage of the movement by snow, ice and debris. However, none of these vertical motion patents have resulted in a practical design that has been implemented. The designs were too weak to withstand the weights and forces experienced during typical railway operation.

In the United States, for example, weights per individual axle exceed 32 metric tons. In addition, tractive effort and braking create longitudinal forces of up to one third of the vertical force.

The advent of high speed rail operations has, strained turnout design even further, with the need to work with small acute angles and high radius switch points. The prior art could neither allow high speeds nor absorb and control such high forces.

DISCUSSION OF THE PRIOR ART

There have been many efforts in the prior art to provide switches and similar components having elements moving in a vertical plane rather than in the traditional horizontal plane.

For example, U.S. Pat. No. 1,574,027 for RAILWAY SWITCH, issued Feb. 23, 1926 to Frank M. Freeberg, discloses a switch apparatus having upstanding cross ribs and downwardly projecting lugs under the switch point, such point being moved both horizontally and vertically to rest on the upstanding cross ribs. The patent requires horizontal as well as vertical motion of the point, thereby ensuring that it is not firmly prevented from moving horizontally while under the pressure of traction and braking forces. This makes the design inherently unstable in the longitudinal axis.

U.S. Pat. No. 1,790,548 for RAILROAD SWITCH, ISSUED Jan. 27, 1931 to Albin P. Lofstrand discloses a switch apparatus wherein a lever with a central pivot point and disposed normally to the rails alternately raises and lowers an element at an opposite rail. Rotary motion is employed in the supporting member.

None of the patents and published patent applications, taken singly, or in any combination, are seen to teach or suggest the novel dual comb apparatus of the proposed system.

SUMMARY

A switch point is moved in conjunction with two comb shaped structures contained in a largely sealed unit.

The upper comb and attached switch point are moved in a vertical plane. The upper comb has downward facing teeth.

The lower comb moves in a horizontal plane and has upward facing teeth. The lower comb alternatively supports the raised upper comb and switch point or allows the upper comb and switch point to be lowered.

When raised, the switch point engages in wheel contact. When lowered, the switch point avoids wheel contact.

It is, therefore, an object of the embodiment to provide a rugged and dependable switch apparatus that can withstand high forces. It is a further object of the embodiment to provide a switch design capable of extending the upper limits of train speed through diverging turnouts. It is a still further object of the embodiment to provide a switch point in a largely sealed unit that can both exclude debris and facilitate installation.

DRAWINGS

Figures

REFERENCE NUMERALS

20 Switch Point
22 Upper Comb
23 Upper Comb Teeth
24 Lower Comb
25 Lower Comb Teeth
26 Thrust Block
28 Thrust Block Rod
30 Thrust Block Channel
32 Base Plate
34 Braces
36 Containment Walls
38 End Plates
40 Counterweights
41 Counterweight cable and cable guides
42 Filtered Air Vent
46 Hydraulic Rams—Vertical motion
47 Hydraulic Rams—Horizontal motion
50 Machinery Spaces
52 Pipe Gallery

DETAILED DESCRIPTION

Figure 1A:
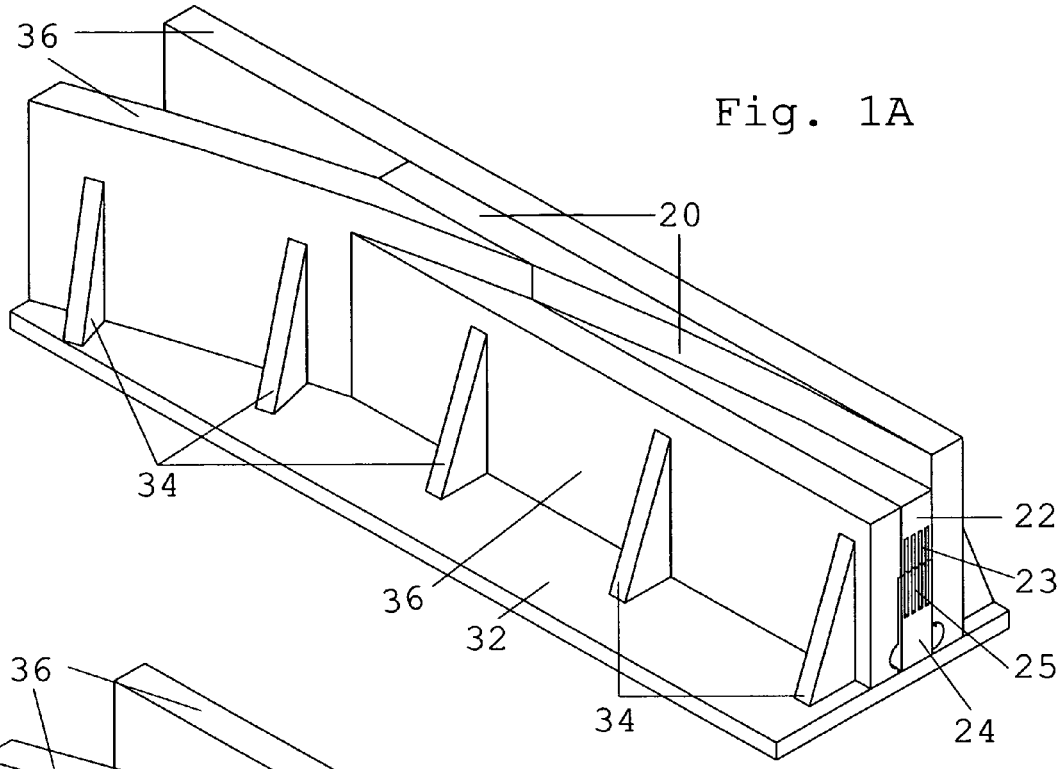
FIG. 1A is a schematic, perspective view of a left hand turnout showing the right side switch point in its upward position.
Figure 1B:
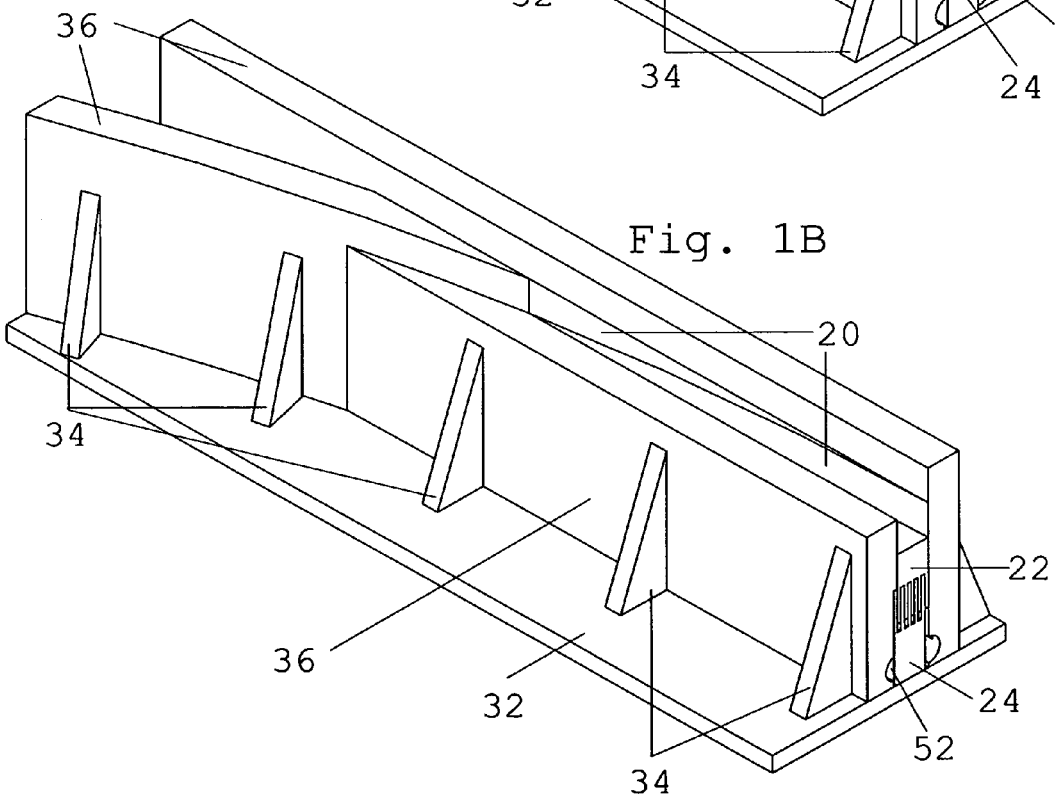
FIG. 1B is the same as FIG. 1A except that the switch point is in its lowered position.

FIGS. 1A and 1B show the right side of a left hand turnout. FIG. 1A shows switch point 20 in an upper position to deflect a flange onto the curved route. FIG. 1B is the same as FIG. 1A but shows switch point 20 in the lowered position to allow the flange to follow the straight route.

Base plate 32 rests on the ties. Containment walls 36 and end plates 38 (not shown) encase the system making it a sealed unit except for the top working surfaces. Containment walls 36 are supported by braces 34.

Containment walls 36 act as running rails when their height is set at top of rail elevation. Some containment walls 36 have less elevation so as to allow the flange to pass overhead without contacting switch point 20. Switch point 20 rests on upper comb 22.

FIG. 1B shows comb structures 22, 24 nested together, positioning switch point 20 in the downward position.

Figure 2A:
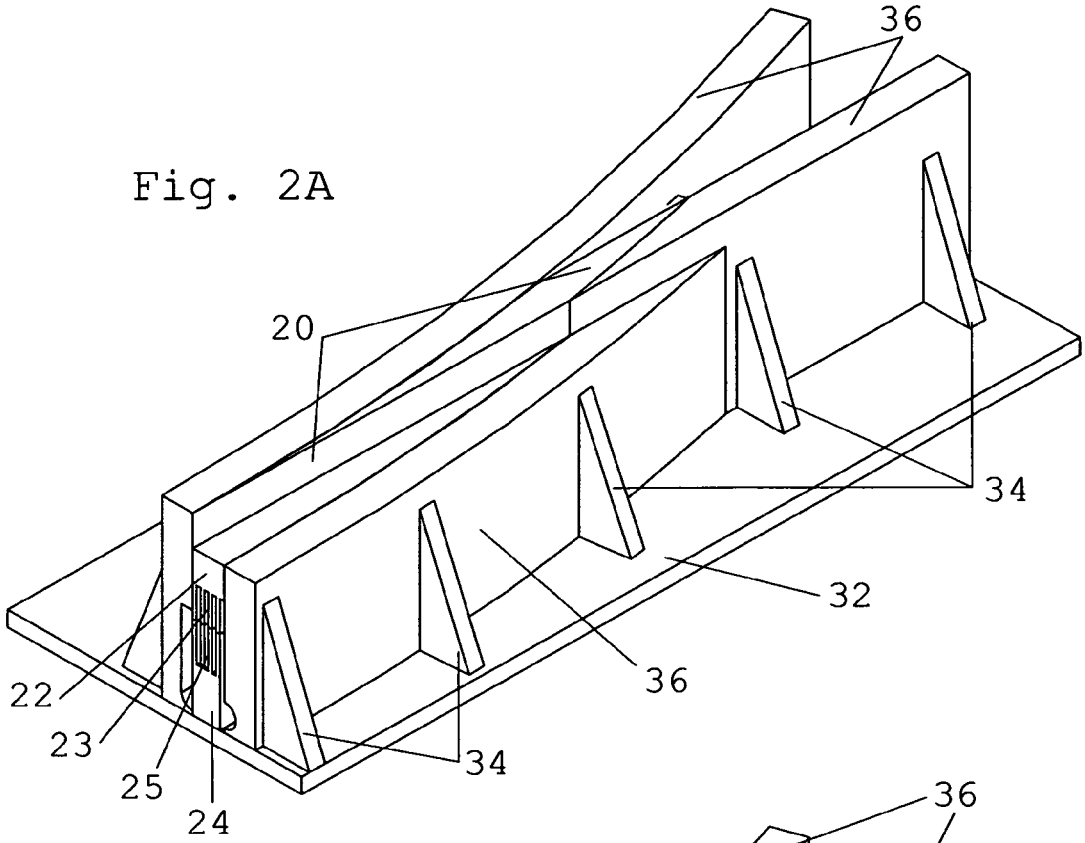
FIG. 2A is a schematic, perspective view of a left hand turnout showing the left side switch point in its upward position.
Figure 2B:
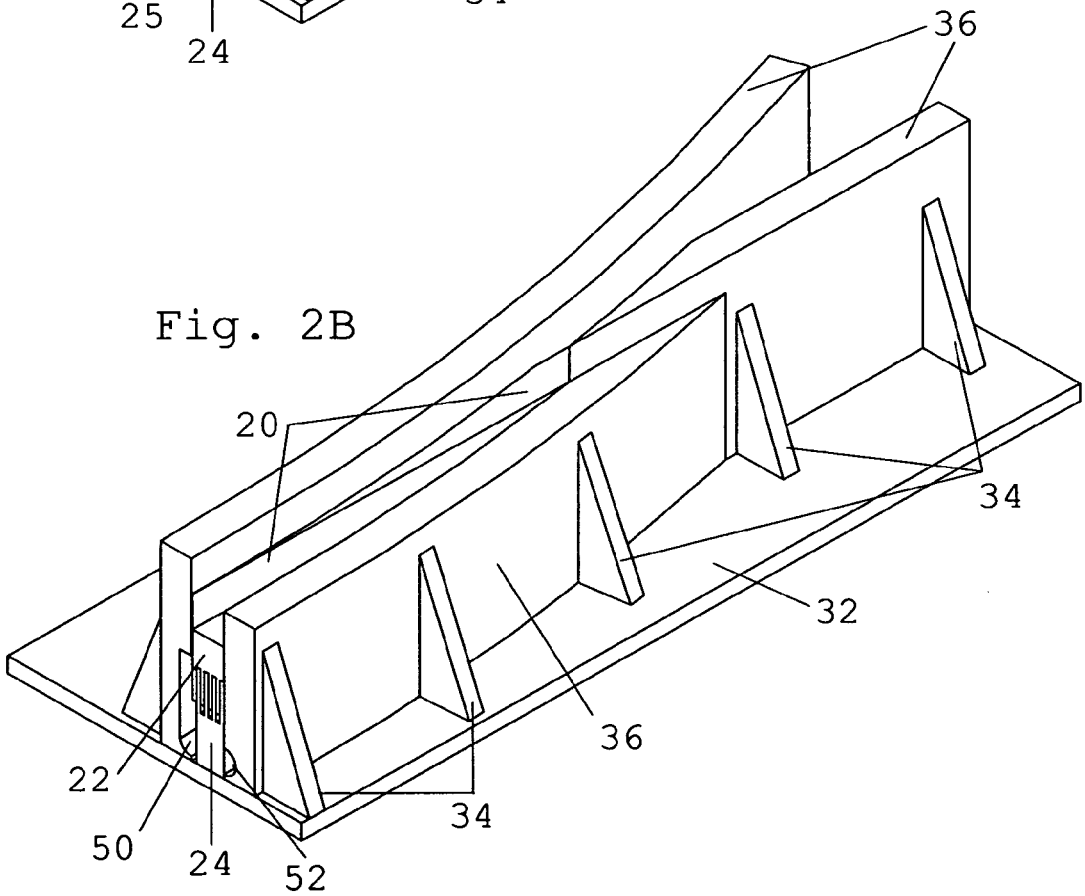
FIG. 2B is the same as FIG. 2A except that the switch point is in its lowered position.

FIGS. 2A and 2B show the left side of a left hand turnout. FIG. 2A shows switch point 20 in an upper position to deflect a flange along the straight route. FIG. 2B is the same as FIG. 2A but shows switch point 20 in the lowered position to allow the flange to follow the curved route. For clarity, end plates 38 are not shown in FIGS. 2A and 2B.

Figure 3:
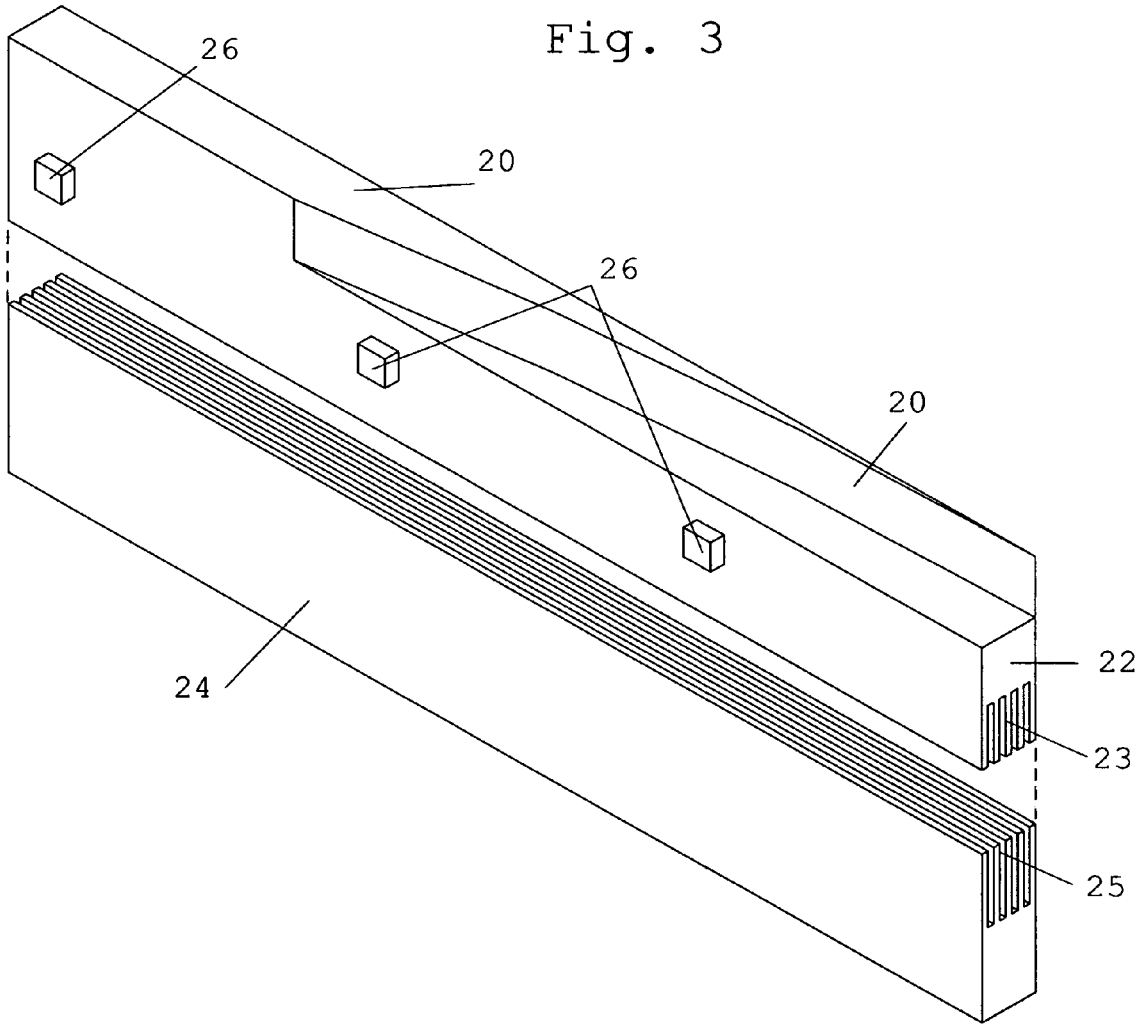
FIG. 3 is a schematic, perspective view of two comb structures having longitudinally disposed teeth.

FIG. 3 is a detail taken from FIG. 1A. FIG. 3 shows a pair of comb shaped structures 22, 24. Switch point 20 is part of upper comb 22. Alternatively, switch point 20 may be a separate part and attached to upper comb 22. To make the longitudinal teeth more visible the two combs are drawn as slightly separated. The number of teeth may vary but are always the same in the two related combs.

Upper comb 22 has teeth that project downward. Lower comb 24 has teeth that project upward. The two combs can be placed one over the other (tooth upon tooth), or alternatively, lower comb 24 can horizontally shift position so that upper comb teeth 23 and lower comb teeth 25 have alternating positions. Upper comb 22 can then descend so that the teeth of the two combs intermesh.

Upper comb 22 and switch point 20 move only in a vertical direction. No horizontal motion is desired or allowed.

Lower comb 24 moves only in a horizontal plane. No vertical motion is allowed. Lower comb 24 movement distance is sufficient to allow upper comb teeth 23 and lower comb teeth 25 to interleave.

The cross sectional contact area of the teeth is greater than the web area of ordinary rail, thereby insuring ample weight distribution without compressive destruction of the teeth.

Located on the sides of upper comb 22 are thrust blocks 26 that fit into thrust block channels 30 on containment walls 36. These insure that upper comb 22 will only move in a vertical plane. Tractive effort and braking effort forces will not be able to shift upper comb 22 out of its fixed longitudinal position.

Figure 4:
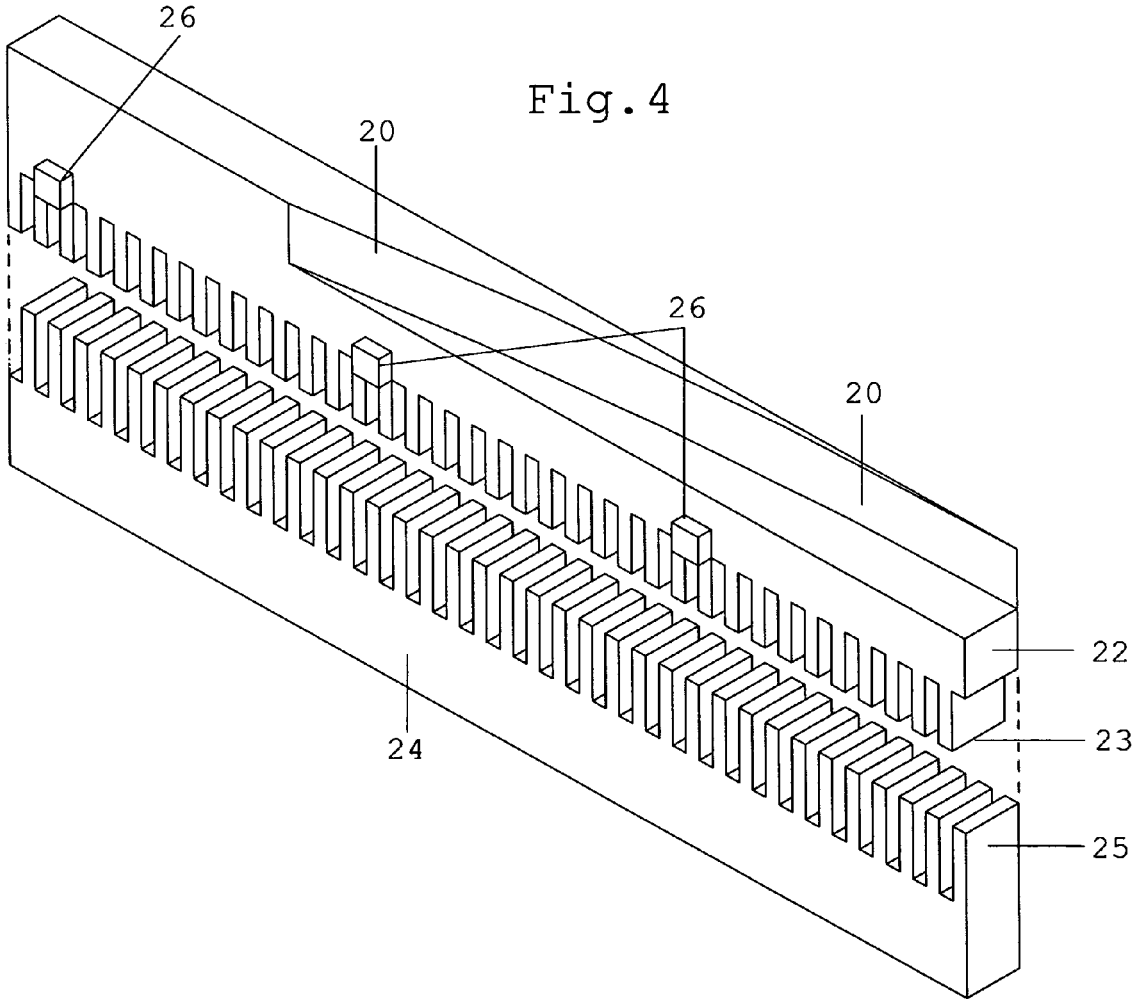
FIG. 4 is a schematic, perspective view of two comb shaped structures having laterally disposed teeth.

In FIG. 4 we show teeth aligned laterally to the long axis. The comb structures are identical to the structures of FIG. 3, except that longitudinally aligned teeth have been replaced by laterally aligned teeth.

Figure 5:
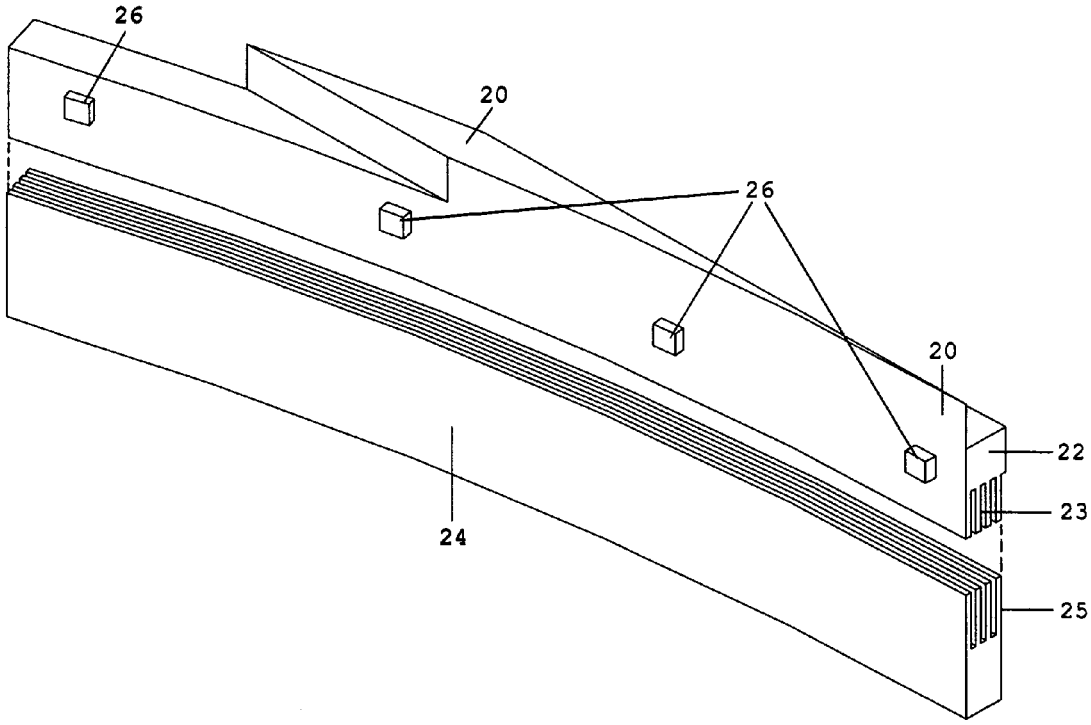
FIG. 5 is a schematic, perspective view of a upper and a lower comb structure having longitudinally disposed teeth in a curvilinear embodiment for application with curved rail sections.

In FIG. 5 we show that the long axis of the comb structures may be curvilinear. The linear form is used when following a straight switch rail. The curvilinear form may be used when following the curvature of a curved switch rail. FIG. 5 is a detail of two comb structures 22, 24 and switch point 20 as shown in FIG. 2A.

For the curvilinear form, lateral teeth alignment follows a radial geometry with the sides of the teeth parallel to a radius line from the curve center.

If longitudinally aligned teeth are used in the curvilinear case, the sides of the teeth follow lines of concentric circles based on the center of such curves. This allows the sets of teeth to properly intermesh. However, such teeth are not geometrically identical when stacked. At the large radius values used in turnouts, however, such a mismatch is insignificant as regards the resulting tooth contact area and the strength of the system.

The tooth array can be arranged so that lower comb 24 moves into machinery space 50 when nested as in FIG. 1B and FIG. 3, or avoid such an incursion into machinery space 50 as shown in FIG. 2B and FIG. 5.

In some embodiments the combs may also be sliced by a vertical plane that follows the sides of switch point 20. The portion of the comb not under the switch point is not bearing train weight and may be trimmed away.

Figure 6:
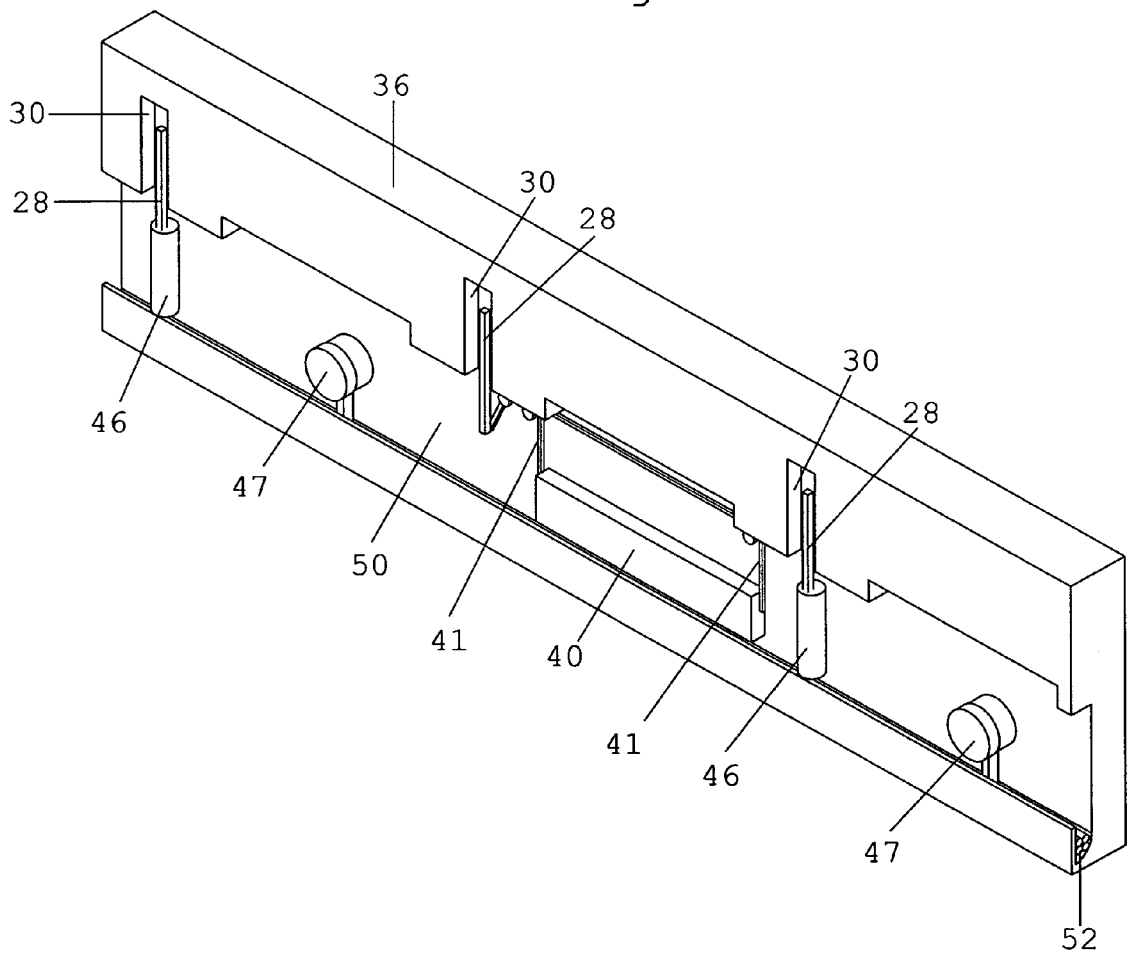
FIG. 6 is a schematic, perspective view of a containment wall showing details of a portion of the actuation mechanisms housed within a hollow region thereof.

FIG. 6 shows the interior of containment wall 36. Containment walls 36 are hollowed out in their lower area to form machinery space 50 in which various devices reside.

Upper comb 22 has sideways projections termed thrust blocks 26. Matching thrust block channels 30 in containment walls 36 allow the upper comb 22 to move vertically while preventing horizontal motion. Longitudinal forces induced by acceleration or deceleration of the train are transferred from thrust block 26 into channel 30 in containment wall 36. Channel 30 extends downward into machinery space 50.

Extending downward from thrust block 26 is thrust block rod 28 that connects to hydraulic ram 46 that pushes or pulls upper comb 22 and switch point 20 up or down.

Horizontal movement of lower comb 24 is achieved with small hydraulic rams 47. If lower comb teeth 25 are laterally disposed, hydraulic ram 47 is near end plate 38 to push or pull on lower comb 24.

If lower comb teeth 25 are longitudinal or concentric, hydraulic rams 47 are placed at intervals along the length of the system as shown in FIG. 6.

The weight of upper comb 22 and switch point 20 may be offset by counterweights 40. Counterweight 40 is periodically connected to rod 28. As rod 28 descends, counterweight 40 moves upward. Counterweight 40 can be linked to rod 28 by levers (not shown) or by flexible cable 41 guided as shown in FIG. 6.

Pipe gallery 52 is provided near the bottom of containment walls 36 for power, communication and pneumatic or hydraulic lines.

End plates 38, not shown, enclose the ends of the containment structures. End plates 38 may have openings as needed to allow the passage of lines from pipe gallery 52.

Moving upper comb 22 changes the internal volume of the unit. This forces air in or out through filtered air vents 42 (not shown) installed in end plates 38.

Resting on base plate 32, the system is a largely sealed structure in which water seepage past upper comb 22 is the only invasive material. Small drain holes (not shown) may be provided to release this seepage.

While hydraulic rams 46, 47 have been discussed, additional external ancillary equipment such as pumps, reservoirs, valves, etc., none of which are shown, are not further described or discussed herein as they are entirely within the state of the art for such systems.

Operation

To raise switch point 20 into flange contact position, pressure is applied to vertical motion rams 46. These move rod 28 upward and with it upper comb 22 and switch point 20. This movement is followed by pressure on horizontal rams 47 which press on lower comb 24 so as to make lower comb teeth 25 align under upper comb teeth 23. This alignment supports upper comb 22 and switch point 20. As upper comb 22 rises, air is pulled into the interior spaces via filtered air vent 42 located in end plates 38.

To lower a switch point away from flange contact position, pressure is applied to horizontal rams 47. These press on lower comb 24 so as to make lower comb teeth 25 shift position, thereby allowing the nesting of lower comb teeth 25 with upper comb teeth 23. This horizontal movement is followed by downward pressure on vertical rams 46. This moves rod 28, upper comb 22 and switch point 20 downward and causes teeth 23, 25 to intermesh in a nested position. As upper comb 22 moves down, air is expelled from the interior spaces.

Advantages

The apparatus of the embodiment can handle any switch angle, curvature and speed as needed. The only two major moving parts used are upper comb 22 with switch point 20 and lower comb 24. This makes the novel apparatus into a reliable, rugged, and dependable mechanism that makes the vertical movement concept viable despite the very large forces and speeds found in modern railway practice.

The virtues of such vertically moving switch elements included the traditional objectives of avoiding blockage of the switch point movement by snow, ice and debris. In addition, each switch point mechanism may be pre-assembled and delivered to an installation site as a unified package ready for installation on the crossties.

Conclusions, Ramifications and Scope

The cross sectional contact area of the teeth exceeds the normal rail web cross section, thereby ensuring the strength to withstand the large forces of modern rail operations.

Since other modifications and changes varied to fit particular operating requirements and environments will be apparent to those skilled in the art, the embodiment is not considered limited to the example chosen for purposes of disclosure, and covers all changes and modifications which do not constitute departures from the true spirit and scope of the invention.

I claim:

1. A railway switch apparatus for switching railway wheels of a railway car traveling on inside and outside rails of a tangential train track to and from a diverging turn-out, the apparatus comprising:

an inside switch point mechanism for switching said inside rail of the tangential train track to an inside rail of the diverging turn-out:

an inside base plate;

an inside straight containment wall affixed to said inside base plate and extending vertically therefrom, said inside straight containment wall having an upper surface in alignment with said inside rail of said tangential train track and a lower surface creating a flangeway;

an inside curved containment wall affixed to said inside base plate and extending vertically therefrom, said inside curved containment wall having an upper surface in alignment with said inside rail of the diverging turn-out;

an inside curved lower comb structure having a plurality of longitudinal teeth extending along the longitudinal length of said inside curved comb structure and extending vertically therefrom concentric to one another, each said tooth of said inside curved lower comb structure comprising a rectangular cross-sectional configuration defining longitudinal rectangular channels between adjacent said longitudinal teeth, said teeth and channels having the same widths;

an inside curved upper comb structure having a plurality of longitudinal teeth extending along the longitudinal length of said inside curved upper comb structure and extending downwardly therefrom concentric to one another, each said tooth of said inside curved upper comb structure comprising a rectangular cross-sectional configuration defining longitudinal rectangular channels between adjacent said longitudinal teeth of said inside curved upper comb structure, said teeth and channels of said inside curved upper comb structure having the same widths as said teeth and channels of said inside curved lower comb structure, said inside upper curved comb structure comprising an inside switch point to switch the inside track to and from the turn-out;

said inside curved lower comb structure being horizontally slidably mounted onto said inside base plate to slide to and from a tangential route position wherein said teeth of said inside curved upper comb structure are respectively vertically aligned axially with and seated onto said longitudinal teeth of said inside curved lower comb structure and a diverging route position wherein said longitudinal teeth of said inside curved lower comb structure are vertically aligned axially with and nested inside said channels of said inside curved upper comb structure;

said inside curved upper comb structure being vertically slidably mounted to slide to and from a raised position wherein said longitudinal teeth of said inside curved lower comb structure are respectively vertically fully seated on said longitudinal teeth of said inside curved lower comb structure when said inside curved lower comb structure is in said tangential route position and a lower position wherein said longitudinal teeth of said inside curved lower comb structure are respectively at least partially seated in said channels of said inside upper comb structure; and a mechanism that, when switching to a divergent path, first horizontally slides said inside curved lower comb structure from said tangential route position to said diverging route position and then vertically lowers said inside curved upper comb structure from said raised position to said lowered position and, when switching to a tangential path, first vertically raises said inside curved upper comb structure from said lowered position to said raised position and then horizontally slides said inside curved lower comb structure from said diverging route position to said tangential route position;

an outside switch point mechanism for switching said outside rail of the tangential train track to an outside rail of the diverging turn-out:

an outside base plate;

an outside straight containment wall affixed to said outside base plate and extending vertically therefrom, said outside straight containment wall having an upper surface in alignment with said outside rail of said tangential train track;

an outside curved containment wall affixed to said outside base plate and extending vertically therefrom, said outside curved containment wall having an upper surface in alignment with said outside rail of the diverging turn-out and a lower surface defining a flangeway;

an outside straight lower comb structure having a plurality of longitudinal teeth extending along the longitudinal length of said outside straight comb structure and extending vertically upwardly therefrom parallel to one another, each said tooth of said outside straight lower comb structure comprising a rectangular cross-sectional configuration defining longitudinal rectangular channels between adjacent said longitudinal teeth, said teeth and channels having the same widths;

an outside straight upper comb structure having a plurality of longitudinal teeth extending along the longitudinal length of said outside straight upper comb structure and extending downwardly therefrom parallel to one another, each said tooth of said outside straight upper comb structure comprising a rectangular cross-sectional configuration defining longitudinal rectangular channels between adjacent said longitudinal teeth of said outside straight upper comb structure, said teeth and channels of said outside straight upper comb structure having the same widths as said teeth and channels of said outside straight lower comb structure, said outside upper straight comb structure comprising an outside switch point to switch the outside track to and from the turn-out;

said outside straight lower comb structure being horizontally slidably mounted onto said outside base plate to slide to and from a tangential route position wherein said longitudinal teeth of said outside straight lower comb structure are respectively vertically aligned axially with and nested inside said channels of said outside straight upper comb structure and a diverging route position wherein said teeth of said outside straight upper comb structure are vertically aligned axially with and seated onto said longitudinal teeth of said outside straight lower comb structure;

said outside straight upper comb structure being vertically slidably mounted to slide to and from a raised position wherein said longitudinal teeth of said outside straight upper comb structure are respectively vertically fully seated onto said longitudinal teeth of said outside straight lower comb structure when said outside straight comb structure is in said diverging route position and a lower position wherein said longitudinal teeth of said outside straight lower comb structure are respectively at least partially nested in said channels of said outside straight upper comb structure; and a mechanism that, when switching to a tangential path, first horizontally slides said outside straight lower comb structure from said diverging route position to said tangential route position and then vertically lowers said outside straight upper comb structure from said raised position to said lowered position and, when switching to a divergent path, first vertically raises said outside straight upper comb structure from said lowered position to said raised position and then horizontally slides said outside straight lower comb structure from said tangential route position to said diverging route position.

2. A railway switch apparatus for switching railway wheels of a railway car traveling on inside and outside rails of a tangential train track to and from a diverging turn-out, the apparatus comprising:

an inside switch point mechanism for switching said inside rail of the tangential train track to an inside rail of the diverging turn-out:

an inside base plate;

an inside straight containment wall affixed to said inside base plate and extending vertically therefrom, said inside straight containment wall having an upper surface in alignment with said inside rail of said tangential train track and a lower surface creating a flangeway;

an inside curved containment wall affixed to said inside base plate and extending vertically therefrom, said inside curved containment wall having an upper surface in alignment with said inside rail of the diverging turn-out;

an inside curved lower comb structure having a plurality of transverse teeth extending along the longitudinal length of said inside curved comb structure and extending vertically upward therefrom parallel to one another, each said tooth of said inside curved lower comb structure comprising a rectangular cross-sectional configuration defining transverse rectangular channels between adjacent said transverse teeth, said teeth and channels having the same widths;

an inside curved upper comb structure having a plurality of transverse teeth extending along the longitudinal length of said inside curved upper comb structure and extending downwardly therefrom parallel to one another, each said tooth of said inside curved upper comb structure comprising a rectangular cross-sectional configuration defining transverse rectangular channels between adjacent said transverse teeth of said inside curved upper comb structure, said teeth and channels of said inside curved upper comb structure having the same widths as said teeth and channels of said inside curved lower comb structure, said inside upper curved comb structure comprising a inside switch point to switch the inside track to and from the turn-out;

said inside curved lower comb structure being horizontally slidably mounted onto said inside base plate to slide to and from a tangential route position wherein said teeth of said inside curved upper comb structure are respectively vertically aligned axially with and seated onto said transverse teeth of said inside curved lower comb structure and a diverging route position wherein said transverse teeth of said inside curved lower comb structure are vertically aligned axially with and nested inside said channels of said inside curved upper comb structure;

said inside curved upper comb structure being vertically slidably mounted to slide to and from a raised position wherein said transverse teeth of said inside curved upper comb structure are respectively vertically fully seated on said transverse teeth of said inside curved lower comb structure when said inside curved lower comb structure is in said tangential route position and a lower position wherein said transverse teeth of said inside curved lower comb structure are respectively at least partially seated in said channels of said inside upper comb structure; and a mechanism that, when switching to a divergent path, first horizontally slides said inside curved lower comb structure from said tangential route position to said diverging route position and then vertically lowers said inside curved upper comb structure from said raised position to said lowered position and, when switching to a tangential path, first vertically raises said inside curved upper comb structure from said lowered position to said raised position and then horizontally slides said inside curved lower comb structure from said diverging route position to said tangential route position;

an outside switch point mechanism for switching said outside rail of the tangential train track to an outside rail of the diverging turn-out:

an outside base plate;

an outside straight containment wall affixed to said outside base plate and extending vertically therefrom, said outside straight containment wall having an upper surface in alignment with said outside rail of said tangential train track;

an outside curved containment wall affixed to said outside base plate and extending vertically therefrom, said outside curved containment wall having an upper surface in alignment with said outside rail of the diverging turn-out and a lower surface defining a flangeway;

an outside straight lower comb structure having a plurality of transverse teeth extending along the longitudinal length of said outside straight comb structure and extending vertically upward therefrom parallel to one another, each said tooth of said outside straight lower comb structure comprising a rectangular cross-sectional configuration defining longitudinal rectangular channels between adjacent said transverse teeth, said teeth and channels having the same widths;

an outside straight upper comb structure having a plurality of transverse teeth extending along the longitudinal length of said outside straight upper comb structure and extending downwardly therefrom parallel to one another, each said tooth of said outside straight upper comb structure comprising a rectangular cross-sectional configuration defining longitudinal rectangular channels between adjacent said transverse teeth of said outside straight upper comb structure, said teeth and channels of said outside straight upper comb structure having the same widths as said teeth and channels of said outside straight lower comb structure, said outside upper straight comb structure comprising an outside switch point to switch the outside track to and from the turn-out;

said outside straight lower comb structure being horizontally slidably mounted onto said outside base plate to slide to and from a tangential route position wherein said transverse teeth of said outside straight lower comb structure are respectively vertically aligned axially with and nested inside said channels of said outside straight upper comb structure and a diverging route position wherein said teeth of said outside straight upper comb structure are vertically aligned axially with and seated onto said transverse teeth of said outside straight lower comb structure;

said outside straight upper comb structure being vertically slidably mounted to slide to and from a raised position wherein said transverse teeth of said outside straight upper comb structure are respectively vertically fully seated onto said transverse teeth of said outside curved lower comb structure when said outside straight lower comb structure is in said diverging route position and a lower position wherein said transverse teeth of said outside straight lower comb structure are respectively at least partially nested in said channels of said outside straight upper comb structure; and a mechanism that, when switching from a tangential path, first horizontally slides said outside straight lower comb structure from said diverging route position to said tangential route position and then vertically lowers said outside straight upper comb structure from said raised position to said lowered position and, when switching to a divergent path, first vertically raises said outside straight upper comb structure from said lowered position to said raised position and then horizontally slides said outside straight lower comb structure from said tangential route position to said diverging route position.

* * * * *